US009018838B2

(12) United States Patent
Schoeller

(10) Patent No.: US 9,018,838 B2
(45) Date of Patent: Apr. 28, 2015

(54) HIGH INTENSITY GAS-DISCHARGE LAMP

(75) Inventor: Klaus Schoeller, Nideggen (DE)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/202,832

(22) PCT Filed: Feb. 17, 2010

(86) PCT No.: PCT/IB2010/050702

§ 371 (c)(1),
(2), (4) Date: Aug. 23, 2011

(87) PCT Pub. No.: WO2010/097732

PCT Pub. Date: Sep. 2, 2010

(65) Prior Publication Data

US 2011/0304266 A1 Dec. 15, 2011

(30) Foreign Application Priority Data

Feb. 24, 2009 (EP) ..... 09153528

(51) Int. Cl.

| | |
|---|---|
| ***H01J 17/20*** | (2012.01) |
| ***H01J 17/04*** | (2012.01) |
| ***H01J 61/82*** | (2006.01) |
| ***H01J 61/12*** | (2006.01) |

(52) U.S. Cl.

CPC ..... *H01J 61/827* (2013.01); *H01J 61/125* (2013.01)

(58) Field of Classification Search

None

See application file for complete search history.

(56) References Cited

U.S. PATENT DOCUMENTS

| | | | |
|---|---|---|---|
| 6,841,938 | B2 | 1/2005 | Hendricx et al. |
| 8,193,711 | B2 | 6/2012 | Deguchi et al. |
| 2003/0057876 | A1 | 3/2003 | Muto |
| 2003/0062839 | A1 | 4/2003 | Takagaki et al. |
| 2004/0150344 | A1 | 8/2004 | Takagaki et al. |
| 2004/0183446 | A1 | 9/2004 | Grundmann et al. |

FOREIGN PATENT DOCUMENTS

| | | | |
|---|---|---|---|
| DE | 10101508 | A1 | 8/2002 |
| EP | 1150337 | A1 | 10/2001 |
| EP | 1351276 | A2 | 10/2003 |
| WO | 02078051 | A1 | 10/2002 |
| WO | WO 2008038245 | A2 * | 4/2008 |
| WO | 2008072154 | A3 | 6/2008 |

* cited by examiner

*Primary Examiner* — Natalie Walford

(57) ABSTRACT

The invention describes a high intensity gas-discharge lamp (1) comprising a discharge vessel (5, 5') enclosing a fill gas in a discharge chamber (2) and comprising a pair of electrodes (3, 3', 4, 4') extending into the discharge chamber (2), and wherein the fill gas includes a halide composition comprising a halide of sodium and, optionally, scandium iodide to a total proportion of at least 30 wt %, and a halide of terbium and/or gadolinium to a proportion of at least 5 wt %.

23 Claims, 2 Drawing Sheets

HIGH INTENSITY GAS-DISCHARGE LAMP

FIELD OF THE INVENTION

The invention describes a high intensity gas-discharge lamp.

BACKGROUND OF THE INVENTION

In a high-intensity discharge lamp, an electric arc established between two electrodes produces an intensely bright light. Such a lamp is often simply referred to as a 'HID' lamp. In prior art HID lamps, a discharge chamber contains a fill gas comprising mostly Xenon and a combination of halides—usually sodium iodide and scandium iodide—and one or more other metal salts that vaporize during operation of the lamp. When used in automotive headlamp applications, HID lamps have a number of advantages over other types of lamp. For instance, the light output of a metal halide xenon lamp is greater than that of a comparable tungsten-halogen lamp. Also, HID lamps have a significantly longer lifetime than filament lamps. These and other advantages make HID lamps particularly suited for automotive headlamp applications.

Along with the color temperature, other characteristics of such lamps, for example operational voltage, lamp driver characteristics, dimensions, etc., are specified in different countries by the appropriate regulations, for example by ECE-R99 in Europe, where 'ECE' stands for 'Economic Commission for Europe'. Often, the lamps specified in these regulations are simply referred to by their designation, e.g. 'D1', 'D4', etc. ECE-R99 requires, for example, that the luminous flux delivered by an automotive gas-discharge headlamp be at least 2750 μm. However, continuing developments in the field of light-emitting diodes (LEDs) will eventually allow their widespread use in automotive headlamps. Since LEDs easily achieve color temperatures above 5000 K, it is to be expected that regulations governing automotive headlamps will be adjusted accordingly.

The color point, or color temperature, of an automotive lamp is crucial for safety. Firstly, the headlamps of a vehicle must sufficiently illuminate the road for the driver of that vehicle, and secondly, other drivers should not be subject to potentially dangerous glare from the headlamps of that vehicle. Furthermore, the color of the light generated by the headlamp is important since it affects the ability of the driver to distinguish objects in the path of the light beam, also referred to as color discrimination.

The color of an automotive headlight must comply with certain standards in order to ensure uniformity and therefore also to promote safety for drivers. One such standard is the SAE system, which was developed by the Society of Automotive Engineers in the USA to define the colors for automotive headlights, and which will be known to a person skilled in the art. Studies have shown that the color temperature of an automotive lamp should be considerably higher than 4000 K, and the X and Y coordinates of the corresponding color point, as graphed using the SAE system, should lie on or close to the black-body line (a locus of points corresponding to an ideal black body radiator). Such color temperature characteristics of automotive headlights improve color discrimination and also recognition of objects in the dark, therefore increasing safety in night-time driving. This is because, even at the same intensity, light with a higher color temperature—for example bluish-white light—is perceived by the human eye to be brighter than light with a lower color temperature, for example light with a yellow hue. These requirements are leading to an increased demand on the part of customers for xenon HID lamps with high efficiency mentioned, but also with a higher color temperature.

However, designing lamps to produce a bluish light is not necessarily a straightforward process, since, under equal conditions, the luminous flux output by a lamp producing blue light is lower than that of a lamp producing yellow light. For this reason, it is difficult to obtain a lamp that delivers a bright white light with a color temperature greater than 4000 K with, at the same time, an acceptable level of luminous flux. In state of the art D1 and D2 (mercury-based) lamps attempting to achieve such a high color temperature, a loss of light output up to 30% is observed, so that the efficiency of these lamps is unsatisfactory. Other D3 and D4 lamps (mercury-free) achieve a light output only marginally satisfying the regulation requirements, for example a light output of only 3200+/−450 lm.

Therefore, it is an object of the invention to provide an improved high-intensity discharge lamp with a high color temperature as well as a high luminous flux.

SUMMARY OF THE INVENTION

The object of the invention is achieved by a high intensity gas-discharge lamp according to claim 1.

The high intensity gas-discharge lamp according to the invention comprises a discharge vessel enclosing a fill gas in a discharge chamber and comprising a pair of electrodes extending into the discharge chamber, and wherein the fill gas includes a halide composition comprising a sodium halide and, optionally, scandium iodide to a total proportion of at least 30 wt %, and a halide of terbium and/or gadolinium to a proportion of at least 5 wt %. Here, a weight percentage specified for a halide or 'metal salt' is the percentage weight of that halide or metal salt in the halide composition. Evidently, if the combined proportion of the sodium halide and (optionally) scandium iodide in the halide composition in a lamp embodiment is 30 wt %, then the proportion of the terbium and/or gadolinium halides can be at most 70 wt %.

Experiments with the lamp according to the invention have shown that a very favorable color temperature was achievable without any detrimental drop in lumen output. For example, a color temperature in the region of 6000 K can be obtained with SAE coordinates very close to the black-body line. Furthermore, the favorable performance of the lamp according to the invention—high color temperature and high light output—was observed to be maintained over the lifetime of the lamp. In a simple and economic solution, therefore, the lamp according to the invention provides a particularly high light output while being cost-effective in manufacture.

Another obvious advantage of the lamp according to the invention is that, with the fill gas described, a very high level of light output (lumens) per Watt, i.e. a high level of efficiency, can be reached with a color temperature well placed in the blue region required for automotive applications. The addition of a terbium halide such as terbium ($TbI_3$) and/or a gadolinium halide such gadolinium iodide ($GdI_3$) results in a significant increase in the color temperature that can be reached at this high level of lamp efficiency.

Advantageously, the lamp according to the invention can be used in place of a prior art D1-D4 headlamp without having to replace any existing electronics or fittings, so that the customer requirements mentioned in the introduction can be met.

The dependent claims and the subsequent description disclose particularly advantageous embodiments and features of the invention.

In the following, pertinent initial lamp parameters such as color temperature, operating voltage, lumen output etc., apply for a lamp age of 15 hours according to ECE regulations. This is because these parameters are obtained after the first fifteen hours of operation of such a lamp, which is regarded as the 'ageing' time.

Furthermore, when reference is made to a halide of a metal in the following without mention of a specific halide, it is to be understood than any suitable halide could be used, for example a bromide, an iodide, etc., without however restricting the invention in any way.

A desired color temperature can be achieved by the lamp according to the invention by appropriate choice of the relative amounts of the various components of the fill gas. Therefore the halide composition of the fill gas of the lamp according to the invention comprises a halide of terbium and/or gadolinium to a proportion, as mentioned above, of at least 5 wt %. This level can deliver a color temperature approaching 5000 K. To further increase the color temperature while maintaining the high efficiency of the lamp, the fill gas of the lamp according to the invention more preferably comprises at least 10 wt %, more preferably at least 30 wt % and most preferably at least 50 wt % of a terbium halide and/or a gadolinium halide.

Without including scandium iodide in the halide composition of the fill gas, the lumen output of the lamp can be ensured by appropriate choice of filling in an outer chamber of the lamp, within which outer chamber the discharge vessel is disposed. For example, the outer chamber fill gas could include Xenon.

The inclusion of scandium iodide in the halide composition of the fill gas allows a favorable level of lumen per Watt to be achieved. The combined amount of sodium iodide and scandium iodide in the fill gas, as already indicated, also serves to ensure the high efficiency of the lamp. Evidently, the relative proportions of these metal salts can be adjusted as required. With approximately equal levels of sodium iodide and scandium iodide, the color output of the lamp is only subject to minor alteration, while predominantly allowing the x-coordinate of the color point to be positioned closer to the black-body line. On the other hand, increasing the relative proportion of sodium iodide while decreasing that of scandium iodide serves to prolong the lifetime maintenance of the lamp, i.e. the lamp can provide relatively constant lumen output over a longer lifetime. Therefore, in a further preferred embodiment of the invention, the proportion of sodium iodide in the halide composition is at least 20 wt % and at most 60 wt %, and the proportion of scandium iodide in the halide composition is at least 20 wt % and at most 40 wt %.

In the previously described embodiments of the lamp according to the invention, the high color temperature and high luminous flux was achieved without the addition of zinc iodide, thus allowing a favorable economical realization of a lamp with high color temperature and high efficiency. To further improve the operating performance of the lamp, an amount of zinc iodide can be added to the halide composition of the fill gas in order to raise the lamp voltage during operation. A suitable amount of zinc iodide can be, for example, between 0.2 wt % and 5.0 wt %.

As mentioned above, it is highly desirable in automotive applications for the color temperature of a headlight to lie close to the black-body line in an SAE representation, as will be known to a person skilled in the art. By appropriate choice of the proportions of the metal salts in the fill gas, a color temperature can be obtained whose color point has x- and y-coordinates that lie on, or at least very close to, the black-body line. Therefore, in a particularly preferred embodiment of the lamp according to the invention, the halide composition of the lamp also comprises indium iodide (InI) to a proportion of at least 0.2 wt % and at most 5.0 wt %. The addition of indium iodide in the given range serves to lower the y-coordinate of the color point, while ensuring that the color point of the lamp is maintained over the lifetime of the lamp according to the invention, even at high color temperatures in the range of 6000 K. Color-point maintenance means that the x- and y-coordinates of the color point do not noticeably change over the lifetime of the lamp.

By adding a small amount of one or more additional salts of rare earth or transition metals, a further "fine-tuning" of the color temperature can be achieved. Therefore, in a further embodiment of the invention, the halide composition preferably comprises a halide of holmium and/or a halide of dysprosium to a proportion of between 5 wt % and 16 wt % of the halide composition. Furthermore, the halide composition preferably also comprises an amount—up to 10 wt %—of one or more halide additives of a group of rare earth and transition metals comprising gallium, lanthanum, neodymium, samarium, thulium, vanadium and yttrium. Examples of suitable halides of this group might be dysprosium iodide ($DyI_3$), samarium iodide ($SmI_3$) or bromide ($SmBr_3$), neodymium iodide ($NdI_3$), yttrium bromide ($YBr_3$), etc. One or more of these halide additives can also, in their ionized state, advantageously act as a gas-phase emitter. The combined proportion of the halide of holmium and/or the halide of dysprosium with the optional halide additive(s) from the group mentioned above preferably does not exceed 35 wt %

The physical construction of a high-pressure gas-discharge lamp, the conditions under which it is operated, and the pressure of the fill gas in the lamp are further parameters that influence the performance and the light output of the lamp. Therefore, in a further preferred embodiment of the invention, the construction parameters of the lamp and the composition of the fill gas, using the halide compositions described above, are chosen such that a color temperature in the range of 5500 K to 7000 K in the SAE field is attained by the lamp when operated with an initial operating voltage of at least 38 V and at most 55 V.

For automotive headlight applications to date, lamps rated at 35 W are generally used. Therefore, the lamp according to the invention preferably has a rated or nominal power of 35 W. The physical construction characteristics of the lamp are preferably such that the capacity of the discharge chamber of the lamp is at least 15 μl and at most 30 μl, while the inner diameter of the discharge chamber can preferably be between 2.2 mm and 2.6 mm, more preferably 2.4 mm; and the outer diameter of the discharge chamber can preferably be between 5.9 mm and 6.3 mm, more preferably 6.1 mm. In such a lamp, the halide composition in the fill gas of the lamp preferably has a combined weight of at least 100 μg and at most 400 μg.

However, the lamp according to the invention is not limited to a 35 W realization. With appropriate choice of construction parameters, the lamp can also be realized, for example, as a 25 W lamp. In such a lamp, the capacity of the discharge chamber is at least 10 μl and at most 25 μl, having an inner diameter preferably measuring between 2.0 mm and 2.4 mm, more preferably 2.2 mm; and an outer diameter measuring preferably between 4.5 mm and 6.1 mm, more preferably 5.5 mm. In this lower-power realization, the halide composition in the fill gas preferably has a combined weight of at least 50 μg and at most 300 μg.

The choice of electrode can govern the stability of the discharge arc in an HID lamp. Maintenance of a stable arc depends to a large extent on the geometry of the electrodes, in particular their diameter, since the thickness of the electrodes governs the electrode temperature that is reached during operation, which in turn determines the commutation behavior and the burn-back of the electrodes according to the ballast parameters. The diameter of the electrode within a pinch region of the lamp according to the invention is therefore preferably at least 200 μm and at most 320 μm, and the diameter at the tip of the electrode is preferably at least 200 μm and at most 360 μm. The electrode can be realized as a simple rod shape of uniform diameter from tip to pinch, or can be realized to be wider at the tip that at the pinch. Evidently, these dimensions apply to the initial dimensions of the electrodes before burning.

As will be known to a person skilled in the art, the electrodes in a HID lamp of the type described here protrude from opposite sides into the discharge chamber, so that the tips of the electrodes are separated by a small gap. In the lamp according to the invention, the electrode tips are preferably separated by a real distance of at least 3 mm and at most 5 mm, preferably 3.6 mm. The optical separation between the electrode tips, i.e. the separation as seen through the glass of the inner chamber, will appear larger than the actual separation. An electrode separation of 3.6 mm may, for example, correspond to an optical separation of 4.2 mm.

The electrodes of HID lamps are generally made of tungsten, since tungsten has a very high melting point, as will be known to the skilled person. A tungsten electrode that contains thorium (called a thoriated tungsten electrode) operates at a temperature below its melting temperature compared to a pure tungsten electrode, so that the electrode is not so prone to deformation during operation. However, thorium is associated with health and environmental risks. Thorium is a low-level radioactive material requiring precautions in handling so as to avoid inhalation or ingestion, and its use is also undesirable from an environmental point of view. Therefore, the electrodes of the lamp according to the invention can preferably be thorium-free tungsten electrodes, i.e. tungsten electrodes that do not comprise a thorium additive.

The discharge vessel of a HID lamp is generally made of quartz glass. Requirements of the light output—for example the light should be as near point-shaped as possible—mean that the discharge chamber must be small. However, a discharge vessel of small dimensions can suffer damage as a result of the high temperatures that are reached during operation. Therefore, in a particularly preferred embodiment of the invention, the discharge vessel is made of a suitable ceramic material such as aluminum oxide.

As already indicated, a HID lamp of the type described herein preferably comprises an additional outer chamber within which the discharge chamber is disposed. This outer chamber can also enclose a fill gas whose composition can be chosen to favorably affect the lumen output, as mentioned above. This outer chamber can be transparent quartz glass, or it can be treated to influence the color of the emitted light. Therefore, in a further preferred embodiment of the invention, the discharge chamber of the lamp is disposed within a quartz glass outer chamber, which outer chamber is treated with a compound of neodymium, for example neodymium oxide ($Nd_2O_3$) and/or a compound of cobalt, for example cobalt aluminate ($CoAl_2O_4$). The effect of these compounds is to absorb yellow light emitted by the lamp during operation. For example, neodymium oxide has a strong absorption band centered at a wavelength of 580 nm so that this yellow light does not pass through the outer chamber wall. The treatment of the outer chamber can therefore comprise, as appropriate, an actual doping of the quartz glass from which the outer chamber is made, or a coating applied to a surface of the outer chamber.

Other objects and features of the present invention will become apparent from the following detailed descriptions considered in conjunction with the accompanying drawings. It is to be understood, however, that the drawings are designed solely for the purposes of illustration and not as a definition of the limits of the invention.

BRIEF DESCRIPTION OF THE DRAWINGS

In the drawings, like numbers refer to like objects throughout. Objects in the diagrams are not necessarily drawn to scale.

In FIG. 1, a cross section of a quartz glass gas-discharge lamp 1 is shown according to an embodiment of the invention. Essentially, the lamp 1 comprises a quartz glass outer chamber 6 enclosing a discharge vessel 5 with a discharge chamber 2 containing a fill gas. Two electrodes 3, 4 protrude into the discharge chamber 2 from opposite ends of the lamp 1. During manufacturing, the quartz glass of the discharge vessel 5 is pinched on both sides around the electrodes 3, 4 to seal the fill gas in the discharge chamber 2. The capacity (or volume) and thermal properties of the discharge chamber 2 are influenced by the inner diameter $D_{inner}$ and outer diameter $D_{outer}$ of the discharge vessel 5. The inner and outer diameters $D_{inner}$, $D_{outer}$ are measured at the widest point.

Figure 1:
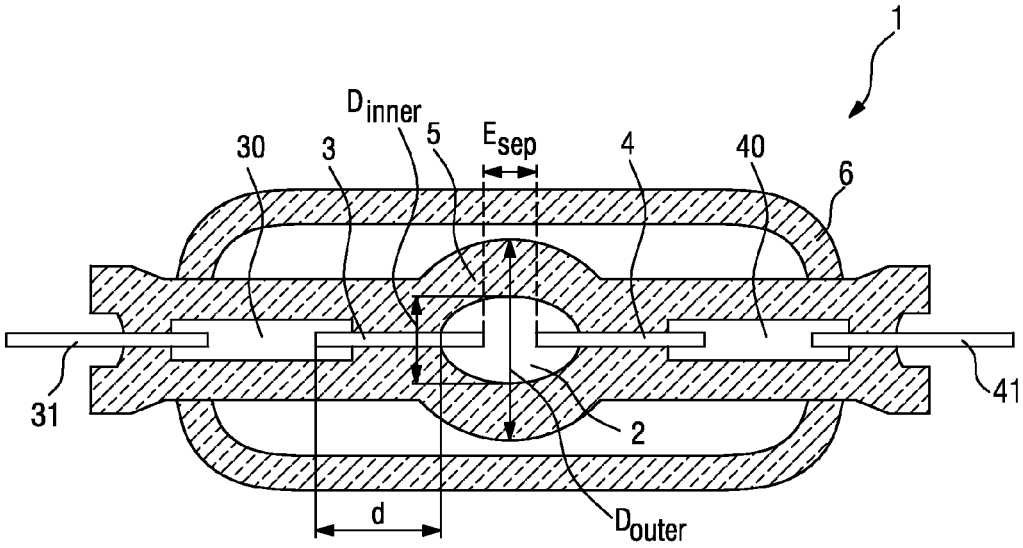
FIG. 1 shows a cross section of a gas-discharge lamp according to first embodiment of the invention.

The electrodes 3, 4 are essentially tungsten rods (thoriated or non-thoriated) that protrude into the discharge chamber 2 and are separated from each other by a distance $E_{sep}$ corresponding to an optical separation of 4.2 mm according to the R99 regulation. The electrodes of a lamp according to the invention can be realized as simple rods of uniform thickness from base to tip. However, the thickness of the electrodes can equally well vary over different stages of the electrodes, so that, for example, an electrode is thicker at its tip and narrower at the base. In the embodiment described in the diagram, electrodes 3, 4 are shown with an outer diameter of up to 300 μm (this value of diameter is the initial value before burning), and protruding a distance d into the pinch area. An electrode 3, 4 is connected to an external lead wire 31, 41 by means of a molybdenum foil 30, 40 in the pinch area.

Figure 2:
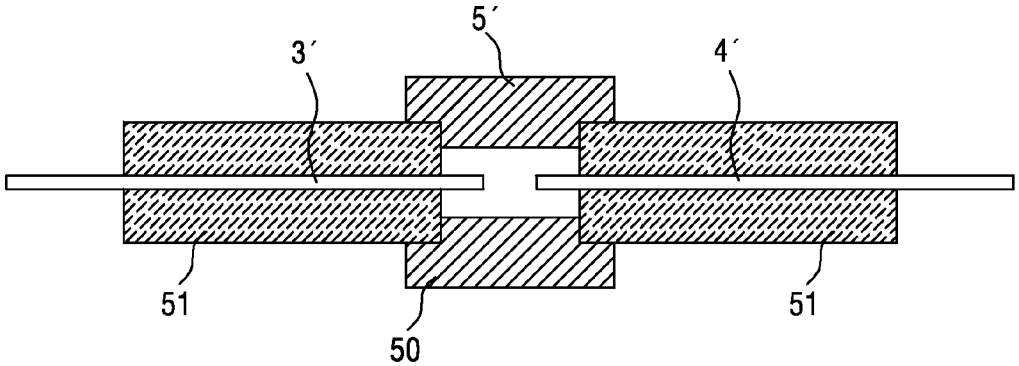
FIG. 2 shows a cross section of a ceramic discharge vessel for a gas-discharge lamp according to a second embodiment of the invention.

FIG. 2 shows an alternative realization of a discharge vessel 5' for the lamp according to the invention, in this example realized using a ceramic material, for instance aluminum oxide. The dimensions of this embodiment of the discharge vessel 5' may be different to those shown in FIG. 1, owing to the different temperature behavior of the ceramic material and to the manner in which such a ceramic discharge vessel 5' can be manufactured. For example, a quartz glass discharge vessel is generally made in one piece from molten glass, shaped while hot, whereas the ceramic discharge vessel 5' shown in the diagram may comprise several separate parts such as a body 50 and end plugs 51, assembled to ensure an air-tight seal. In this example, the electrodes 3', 4' are shown to continue through the ceramic end plugs, but may comprise one or more distinct sections.

For the sake of clarity, the above diagrams show only the parts that are pertinent to the invention. Not shown is the base and the ballast that is required by the lamp for control of the voltage across the electrodes. When the lamp 1 is switched on, the ballast's igniter rapidly pulses an ignition voltage at several thousand volts across the electrodes 3, 4, 3', 4' to initiate a discharge arc. The heat of the arc vaporizes the metal salts in the fill gas. Once the arc of high luminous intensity is established, the ballast regulates the power, so that the voltage across the electrodes 3, 4, 3', 4' accordingly drops to the operational level, in this example, to a level between 38V and 55V.

Since potentially damaging ultraviolet light is generated by the arc in the HID lamp 1, the discharge vessel 5, 5' may be enclosed by a doped quartz glass shield or envelope to absorb this radiation. Such an outer chamber 6 is shown in FIG. 1. This outer chamber 6 can be treated by doping the glass itself, for example with neodymium oxide ($Nd_2O_3$), or by applying a coating of, for example, cobalt aluminate ($CoAl_2O_4$) to an inner or outer surface of the outer chamber 6, using techniques that are known to the skilled person. This treatment ensures that yellow light is absorbed, allowing a further improvement of the 'blueness' of the light emitted by the lamp 1. The light that is passed through is then collected and distributed using HID-specific optics, not shown in the diagram, such as reflectors and collimators in headlamp construction for ensuring that as much as possible of the light output is put to use. Since these and other additional components will be known to a person skilled in the art, they need not be explained in more detail here.

Figure 3:
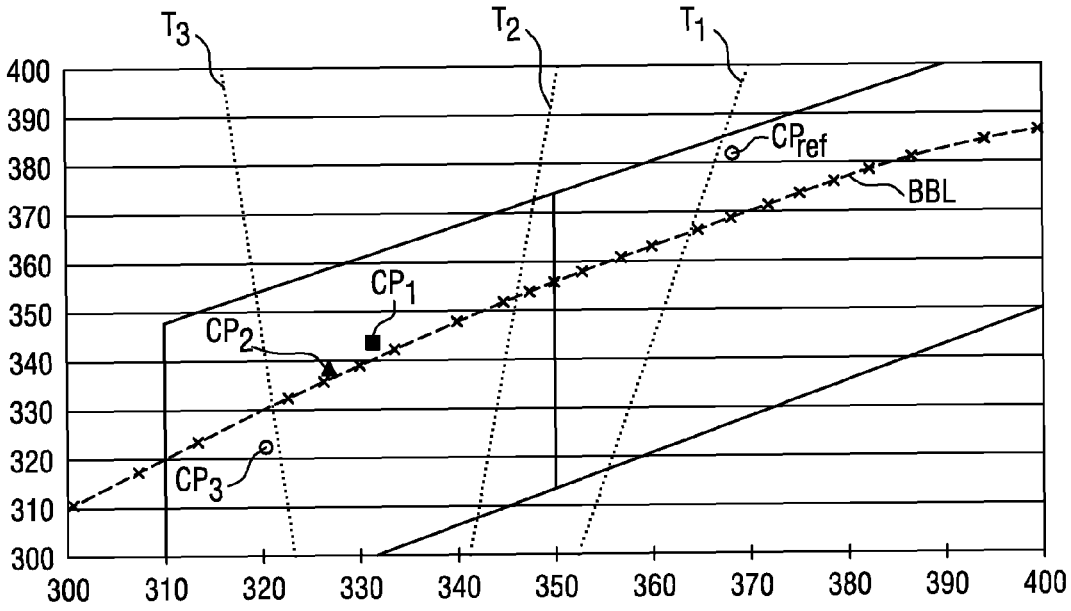
FIG. 3 shows an SAE chart of the color point of a D4S lamp according to the invention after 15 hours of burning.

FIG. 3 shows an SAE graph which plots the x- and y-coordinates of the observed color point. The solid black lines indicate the 'reglement', or the limits for a permissible range in color temperature while the broken line BBL represents the black-body line. Three relevant color temperature curves are given by the dotted lines T1, T2, T3 which correspond to color temperatures of 4000K, 5000K, and 6000K respectively. The color point $CP_{ref}$ corresponds to a prior art D4 reference lamp with 52 wt % NaI, 37.8 wt % $ScI_3$, 0.2 wt % InI, and 10 wt % $ZnI_2$ in the halide composition of the fill gas. This lamp achieves a color point $CP_{ref}$ of only 4200 K. Furthermore, as can be seen from the diagram, the color point $CP_{ref}$ achieved by this lamp is close to the regalement boundary, and is therefore unsatisfactory. The color point $CP_1$ corresponds to a first lamp according to the invention with 33 wt % NaI, 24 wt % $ScI_3$, and 43 wt % $GdI_3$ in the fill gas. This lamp yields a satisfactory color temperature of 5700 K and with the color point $CP_1$ close to the black-body line. The color point $CP_2$ corresponds to a second lamp according to the invention with 26 wt % NaI, 23 wt % $ScI_3$, and 51 wt % $TbI_3$ in the halide composition of the fill gas. This lamp yields an even higher color temperature of 5800 K. The color point $CP_2$ is also a little closer to the black-body-line, and therefore delivers satisfactory values for color temperature and luminous flux. The first and second lamp embodiments described here delivered a satisfactory light output of 2850 and 2800 lm respectively, at about 80 lm/W, thus comparing very favorably with prior art lamps attempting to reach high color temperatures, which only deliver about 70 lm/W and fail to achieve a satisfactory maintenance. A lamp embodiment with a higher color temperature closer to the 6000 K line is indicated by the color point $CP_3$ and corresponds to a third lamp according to the invention with 31 wt % NaI, 37 wt % $GdI_3$, 16 wt % $DyI_2$ and 16 wt % $HoI_3$ in the fill gas. This lamp delivers a particularly high color temperature (6140 K) and an overall favorable luminous flux (2300 μm) without requiring a compensatory outer bulb filling.

Although the present invention has been disclosed in the form of preferred embodiments and variations thereon, it will be understood that numerous additional modifications and variations could be made thereto without departing from the scope of the invention. For the sake of clarity, it is also to be understood that the use of "a" or "an" throughout this application does not exclude a plurality, and "comprising" does not exclude other steps or elements.

The invention claimed is:

1. A high intensity gas-discharge lamp comprising a discharge vessel enclosing a fill gas in a discharge chamber and comprising a pair of electrodes extending into the discharge chamber, and wherein the fill gas includes a halide composition comprising:

a halide of sodium to a total proportion of at least 20 wt %;

scandium iodide to a total proportion of at least 20 wt %; and, a halide of terbium and/or gadolinium to a proportion of at least 5 wt %.

2. A lamp according to claim 1, wherein the halide composition comprises a halide of terbium and/or gadolinium to a proportion of 10 wt %-30 wt %.

3. A lamp according to claim 1, wherein the halide of sodium comprises sodium iodide.

4. A lamp according to claim 3, wherein the proportion of sodium iodide in the halide composition is at least 20 wt % and at most 60 wt %, and the proportion of scandium iodide in the fill gas is at least 20 wt % and at most 40 wt %.

5. A lamp according to claim 1, wherein the halide composition comprises a halide of indium to a proportion of at least 0.2 wt %.

6. A lamp according to claim 1, wherein the halide composition comprises holmium iodide and/or dysprosium iodide;

and/or one or more halide additives of a group of rare earth metals comprising gallium, lanthanum, neodymium, samarium, thulium, vanadium and yttrium;

wherein the additives are combined proportion of at most 35 wt %.

7. A lamp according to claim 1, wherein the construction parameters of the lamp and the composition of the fill gas are chosen such that a color temperature in the range of 4000 K to 10000 K is attained by the lamp when operated with an initial operating voltage between 38 V and 55 V.

8. A lamp according to claim 1, wherein the fill gas comprises xenon gas under a pressure of at least 12 bar and at most 17 bar in a non-operational state.

9. A lamp according to claim 1 with a nominal power of 35 W, and for which lamp wherein the capacity of the discharge chamber is greater than or equal to 15 μl and less than or equal to 30 μl;

the inner diameter of the discharge chamber comprises at least 2.2 mm and at most 2.6 mm;

the outer diameter of the discharge chamber comprises at least 5.9 mm and at most 6.3 mm; and the halide composition in the fill gas of the lamp has a combined weight of 100 μg-400 μg.

10. A lamp according to claim 1 with a nominal power of 25 W, and for which lamp the capacity of the discharge chamber is greater than or equal to 10 μl and less than or equal to 25 μl;

the inner diameter of the discharge chamber comprises at least 2.0 mm and at most 2.4 mm;

the outer diameter of the discharge chamber comprises at least 4.5 mm and at most 6.1 mm; and the halide composition in the fill gas of the lamp has a combined weight of at least 50 μg and at most 300 μg.

11. A lamp according to claim 1, wherein the electrodes are arranged at opposing ends of the discharge chamber and for which electrodes the diameter of an electrode within a pinch region of the lamp is at least 200 μm and at most 320 μm, and the diameter at the tip of the electrode is at least 200 μm and at most 360 μm.

12. A lamp according to claim 1, wherein the tips of the electrodes are separated by a distance of 3 mm-5 mm.

13. A lamp according to claim 1, wherein the discharge vessel is at least partially made of a ceramic material.

14. A lamp according to claim 1, wherein the discharge vessel of the lamp is disposed within a quartz glass outer chamber, which outer chamber is treated with a compound of neodymium and/or a compound of cobalt.

15. A lamp according to claim 3, wherein the total proportion of halide of sodium is at least 40 wt %.

16. A high intensity gas-discharge lamp comprising a discharge vessel enclosing a fill gas in a discharge chamber and comprising a pair of electrodes extending into the discharge chamber, and wherein the fill gas includes a halide composition comprising:

scandium iodide to a total proportion of at least 30 wt %; and, a halide of terbium and/or gadolinium to a proportion of at least 5 wt %.

17. A lamp according to claim 16, wherein the halide composition comprises a halide of terbium and/or gadolinium to a proportion of 10 wt %-30 wt %.

18. A high intensity gas-discharge lamp comprising a discharge vessel enclosing a fill gas in a discharge chamber and comprising a pair of electrodes extending into the discharge chamber, and wherein the fill gas includes a halide composition comprising:

scandium iodide to a total proportion of at least 30 wt %; and, a halide of gadolinium to a proportion of at least 5 wt %.

19. A lamp according to claim 18, wherein the halide composition comprises holmium iodide and/or dysprosium iodide;

and/or one or more halide additives of a group of rare earth metals comprising gallium, lanthanum, neodymium, samarium, thulium, vanadium and yttrium;

wherein the additives are combined proportion of at most 35 wt %.

20. A lamp according to claim 1, wherein the fill gas does not include mercury.

21. A lamp according to claim 1, wherein the fill gas is substantially free of mercury.

22. A lamp according to claim 1, wherein the proportion of the halide of sodium is substantially equal to the proportion of scandium iodide.

23. A lamp according to claim 1, wherein the proportion of the halide of sodium is substantially less than the proportion of scandium iodide.

* * * * *